US012012961B2

(12) United States Patent
Steffens

(10) Patent No.: US 12,012,961 B2
(45) Date of Patent: Jun. 18, 2024

(54) **VOLUME RATIO FOR A R718* COMPRESSOR**

(71) Applicant: R-718 SPINDEL GBR, Pinneberg (DE)

(72) Inventor: Ralf Steffens, Esslingen (DE)

(73) Assignee: R-718 SPINDEL GBR, Pinneberg (DE)

( * ) Notice: Subject to any disclaimer, the term of this patent is extended or adjusted under 35 U.S.C. 154(b) by 0 days.

(21) Appl. No.: 17/794,062

(22) PCT Filed: Jan. 20, 2021

(86) PCT No.: PCT/EP2021/051215
§ 371 (c)(1),
(2) Date: Jul. 20, 2022

(87) PCT Pub. No.: WO2021/148475
PCT Pub. Date: Jul. 29, 2021

(65) Prior Publication Data

US 2023/0167823 A1 Jun. 1, 2023

(30) Foreign Application Priority Data

Jan. 21, 2020 (DE) ..... 102020000350.8

(51) Int. Cl.
*F04C 18/16* (2006.01)
*F04C 18/56* (2006.01)
*F04C 28/10* (2006.01)

(52) U.S. Cl.
CPC ..... *F04C 18/16* (2013.01); *F04C 18/565* (2013.01); *F04C 28/10* (2013.01);
(Continued)

(58) Field of Classification Search
CPC ..... F04C 18/16; F04C 18/565; F04C 28/10; F04C 2250/201
See application file for complete search history.

(56) References Cited

U.S. PATENT DOCUMENTS 3,151,806 A 10/1964 Whitfield
4,058,988 A * 11/1977 Shaw ..... F04C 18/16 62/196.2

(Continued)

FOREIGN PATENT DOCUMENTS

CN 101375062 A 2/2009
CN 106795884 A 12/2018

(Continued)

OTHER PUBLICATIONS

International Search Report dated May 3, 2021; International Publication PCT/EP2021/051215.

(Continued)

*Primary Examiner* — Mary Davis
(74) *Attorney, Agent, or Firm* — DINSMORE & SHOHL LLP

(57) ABSTRACT

Compression of water vapour as R718 is disclosed with and without addition of additives as an aqueous solution in rotational displacement machines, i.e. refrigeration, air-conditioning and heat pump technology. To largely avoid over or under-compression, it is proposed for the easiest possible adaptation of the currently effective internal volume ratio as so-called iV value in the displacer that the compressor housing starting from the outlet side with rotor profile length $L_R$ over a length $L_{iV}$ comprises planar, i.e. flat iV disks (3$_j$) with the index j for $1 \leq j \leq n$; n is the number of disks; $n \geq 1$ with a width $b_j$ per iV disk having planar surfaces $P_F$ preferably perpendicular to the neutral axis $A_N$. The iV disks are displaced in a targeted manner individually by movement control devices (5$_j$) per iV disk in each case by a distance $s_i$ where $0 < s_i \leq s_j$.

11 Claims, 6 Drawing Sheets

(52) U.S. Cl.
CPC .. *F04C 2210/1094* (2013.01); *F04C 2210/26* (2013.01); *F04C 2250/201* (2013.01)

(56) References Cited

U.S. PATENT DOCUMENTS

| | | | |
|---|---|---|---|
| 2015/0118093 | A1 | 4/2015 | Steffens |
| 2016/0319815 | A1 | 11/2016 | Akei |

FOREIGN PATENT DOCUMENTS

| | | | | | |
|---|---|---|---|---|---|
| CN | 111022325 | B | * | 6/2021 | ..... F04C 18/16 |
| DE | 19519262 | A1 | | 12/1996 | |
| DE | 102018001519 | A1 | | 8/2019 | |
| EP | 0775826 | A1 | | 5/1997 | |
| WO | 2011149444 | A1 | | 12/2011 | |
| WO | 2019002363 | A1 | | 1/2019 | |

OTHER PUBLICATIONS

Chinese Office Action dated Apr. 28, 2023; Application No. 202180010278.5.

* cited by examiner

VOLUME RATIO FOR A R718* COMPRESSOR

CROSS-REFERENCE TO RELATED APPLICATIONS

This application is the U.S. National Stage of PCT/EP2021/051215 filed on Jan. 20, 2021, which claims priority to German Patent Application 102020000350.8 filed on Jan. 21, 2020, the entire content of both are incorporated herein by reference in their entirety.

BACKGROUND OF THE INVENTION

The refrigeration market is currently changing and thus, for example the so-called "F gas regulation" in accordance with (EU) Regulation No. 842/2006 and No. 517/2014 relating to fluorinated greenhouse gases is on everyone's lips as a challenge to reduce the use of the predominant fluorinated refrigerants (FKW, HFO) because of their harmfulness to the climate and environment. In refrigeration technology there is therefore a strong desire for natural refrigerants, wherein water is particularly impressive on account of its good thermodynamic properties.

So far however, the extensive implementation of water as R718 refrigerant comes unstuck because, for example, compared with ammonia in the same function an approximately 300 times greater conveyed volume flow is required for the same performance. Since at the same time, the pressure ratio above a factor of 10 if possible is extremely high, the requirements for a compressor increase enormously which at the same time must also be oil-free and must operate as efficiently as possible in vacuum namely between 6 mbar and 200 mbar and possibly higher.

The disruptive character of water as R718 refrigerant is undisputed and will abruptly end the intensive discussions being conducted worldwide relating to the known environmental and climate problems with present-day refrigerants.

So far attempts have been made to meet this challenge by means of turbo-compressors wherein these machines only create lower pressure ratios of about 6 despite two-stage designs with intermediate cooling so that in the refrigeration circuit the necessary heat dissipation at the condenser (liquefier) is only implemented unsatisfactorily. Added to this is the serious disadvantage in a flow machine with regard to the soft working characteristic (i.e. pressure values over volume flow) in order to be able to ensure stable operating points for various operating points.

There is no question that a displacement machine is the better solution for water vapour compression in order to overcome these challenges of water vapour compression in R718 refrigeration circuits. For this R718 task however some weaknesses of the present-day displacement machines must be eliminated and the efficiency of the compressor improved. Since these compressors preferably comprise two-wave rotational displacement machines, for example, according to DE 10 2018 001 519 A1, an essential feature in these machines is that they have a so-called "internal volume ratio", hereinafter designated for short as "iV". This iV value is obtained as the ratio between working chamber volume on the inlet side to working chamber volume on the outlet side as a dimensionless number and in the case of a spindle rotor pair is predominantly formed by means of crossing angle, diameter and slope behaviour. For a finished spindle rotor pair this iV value is fundamentally a fixed invariable quantity which for the R718 task usually lies in the range between 3 and 20 in order to be able to satisfy a wide working range.

Now however in usage there are different and variable usage conditions, for example, between hot and cold ambient temperatures which frequently varies. Thus, it would be advantageous if the iV value of the R718 compressor was adaptable in order to avoid over- or under-compression, which is harmful to the efficiency, in the best possible way and be able to set the optimal effective iV value in each case in each operating point. Previous approaches, for example, using control spheres are relatively unfavourable because both the necessary flow cross-sections and also the pressure differences are very small so that the currently effective iV value can only insufficiently prevent harmful over- or under-compression. Accordingly, the object for the present invention can be described as follows with respect to the prior art.

Notes

When there is talk of the R718* compressor here, this also includes the addition of ethanol, for example, when the compressor is also operated below 0° C. and ice formation is to be avoided. In order to include this addition, the designation R718* compressor is used from hereon in this text, wherein the addition preferably with an alcohol (such as ethanol, for example) as an aqueous solution is included with the asterisk *.

When the spindle rotor pair (2) is referred to as "multistage", this means that between the inlet (1.1) and the outlet (1.2) there are several closed spindle-rotor-pair working chambers in that the known profile wrap-around angle goes significantly beyond 360°. This multistage nature of the spindle rotor pair (2) can be a basic requirement for the implementation of this invention for preferred embodiments.

SUMMARY OF THE INVENTION

Compared to the prior art, an R718* displacement compressor should be implemented in such a manner that the effective iV value is designed to be reliably adaptable as efficiently and promptly as possible to various operating conditions as easily, reliably and cost-effectively as possible over a wide working range in order to largely avoid over or under-compression during operation which is harmful to the efficiency.

According to the invention, this object for iV adaptation in an R718* displacement compressor according to claim 1 with the spindle rotor pair (2) is achieved in that the compressor housing (1) starting from the outlet side (1.2) with a rotor profile length $L_R$ over a length $L_{iV}$ comprises planar (i.e. flat) iV disks ($\mathbf{3}_j$) with the index j for $1 \leq j \leq n$ where n is the number of these iV disks ($\mathbf{3}_j$) where $n \geq 1$ with a width $b_j$ per iV disk ($\mathbf{3}_j$) having planar surfaces $P_F$ preferably perpendicular to the neutral axis $A_N$, wherein the iV disks ($\mathbf{3}_j$) for the respective operating conditions are specifically individually displaced via movement control devices (5) in each case by a distance $s_i$ where $0<s_i \leq s_j$ and thus gas emissions $G_{o1}$ and $G_{o2}$ as well as $G_{oS}$ into the condensation chamber (1.2) are made possible in such a manner as to largely avoid over or under-compression.

The number n and the widths $b_j$ per iV disk ($\mathbf{3}_j$) are determined according to the gradient and the designed area of usage of the R718* displacement compressor and are therefore designed to be application-specific. The distances s can be designed to be different per iV disk ($\mathbf{3}_j$) and are then designated as $s_j$. It is particularly useful and advantageous in this case that preferably virtually any intermediate position $s_i$ where $0<s_i \leq s_j$ can be set on the distance s by means of the movement control devices (5) so that the gas emission $G_{o1}$ and $G_{o2}$ can be specifically set for the current operating conditions whereas a gas emission as $G_{oS}$ continues to take place via the gas conveying thread of the spindle rotor pair (2).

Preferably the precise positioning of each iV disk ($\mathbf{3}_j$) is accomplished via position pins (4) with respect to the compressor housing (1) and with respect to one another so that in the closed state, as shown for example in FIG. 1, when all the iV disks, preferably clearly defined by the positioning pins (4), abut against one another, the clearance values between spindle rotor pair (2) and compressor housing (1) are always maintained, and preferably any contact between spindle rotor pair (2) and compressor housing (1) is reliably prevented, wherein further preferably in this state of the completely abutting iV disks the production machining of the internal contour of the compressor housing (1) is taking place.

With the rotor profile length $L_R$, the length $L_{iV}$ can now be selected in such a manner that on the inlet side at least the first working chamber is closed. The maximum iV value is achieved in the so-called "closed state" when therefore all the iV disks are completely abutting.

When manufacturing the internal contour enclosing the spindle rotor pair (2) in the compressor housing (1), all iV-disks (3) can preferably be pressed flat and firmly onto each other in accordance with the closed state and clearly fixed via the positioning pins (4), so that the entire internal contour for the compressor housing (1) and simultaneously for all iV-disks (3) can be manufactured simultaneously, so that over the entire length $L_R$ the desired clearance values for the spindle rotor pair (2) can be achieved throughout.

Further preferably guide support surfaces ($F_F$) can be designed in such a manner that during displacement of the respective iV disks ($\mathbf{3}_j$) with correspondingly suitable application of force via the movement control devices ($\mathbf{5}_j$) for displacement of the respective iV disks ($\mathbf{3}_j$) the circumferentially uniform movement of the respective iV disks ($\mathbf{3}_j$) over corresponding guide lengths and guide accuracies is ensured and any canting of the iV disks ($\mathbf{3}_j$) is avoided.

Even further preferably, the guide support surfaces ($F_F$) can be related to the central guide diameter ØDF in the same way as the uniform application of force via the movement control devices ($\mathbf{5}_j$) per iV disk ($\mathbf{3}_j$).

In order to reliably avoid canting of the respective iV disks during movement of these iV disks, guide support surfaces $F_F$ can thus be provided and the application of force for the movement of the iV disks by means of the movement control devices (5) is preferably accomplished by reference to the central support ØDF with respect to the neutral axis $A_N$ uniformly over the entire circumference in order to avoid canting or clamping of the iV disk movement.

The movement control devices (5) per iV disk are preferably operated by R718* water hydraulics.

It can further be provided that specifically for each operating point any intermediate position $s_i$ where $0<s_i\leq s_j$ with $s_j$ as the maximum displacement distance per iV disk ($\mathbf{3}_j$) is made possible.

In the same way as the gas emission $G_{oS}$ and $G_{o2}$, the gas emission $G_{o1}$ is preferably accomplished directly into the condensation chamber (1.2).

It is preferably provided that the planar surfaces ($P_F$) per iV disk ($\mathbf{3}_j$) are designed for easy sealing with respect to one another and with respect to the compressor housing (1) with correspondingly smooth, shiny and preferably ground surfaces.

The sealing between abutting iV disks is therefore preferably accomplished via the flat planar surfaces $P_F$ with correspondingly shiny or smooth contact surfaces (preferably surface-ground) and can optionally be improved, for example, by means of inserted O rings in corresponding grooves with a retaining function.

Depending on the respective area of usage of the operating conditions and the selected gradient at the spindle rotor pair (2), the number n of iV disks ($\mathbf{3}_j$) and the width thereof $b_j$ can be specified in such a manner that, in a manner specific to the application, over- or under-compression which is harmful to the efficiency can be avoided in the best possible manner. A more precision instruction cannot be given here since each compressor manufacturer executes this design individually for his customer requirements.

It can further be provided that the iV disks ($\mathbf{3}_j$) are positioned for the respective working/operating point in such a manner via the movement control devices ($\mathbf{5}_j$) per iV disk ($\mathbf{3}_j$) that the R718* compressor is operated with the lowest energy expenditure.

It is preferably provided that with a rotor profile length $L_R$ the length $L_{iV}$ of the iV disks ($\mathbf{3}_j$) is designed in such a manner that at least the first working chambers on the compressor inlet side (1.1) always remain closed.

In addition, it can be provided that the position pins (4) take over both the exact positioning per iV disk ($\mathbf{3}_j$) and also during displacement of the iV disks via the movement control devices ($\mathbf{5}_j$) the guidance and entrainment thereof.

The greatest challenge for the most energy-efficient adaption of the iV value consists in forming sufficient flow cross-sections without significant pressure losses for various operating points because the absolute pressure differences are very small if, for example, as the widest working range (for which the compressor iV value is preferably designed) compression is to be carried out from 10 mbar, corresponds to a vaporization temperature of about 7° C. for pure R718 to 200 mbar, corresponds to a liquefaction temperature of about 60° C. for pure R718 (can also be designated as temperature stroke) but at the same time under different usage conditions with the same machine, for example, compression should also be carried out from 25 mbar to 90 mbar Then the outlet at the compressor must take place significantly earlier (i.e. at a lower iV value). In order that the conveyed R718* medium is then emitted earlier, the pressure differences as flow differences in the available cross-sections must not be so large so that the conveyed medium can flow out earlier with the lowest possible resistances. Specifically pressure differences of only a few mbar can be involved here, i.e. significantly below 10 mbar wherein the simple statement applies:

The lower the pressure losses in the case of more premature outlet for smaller temperature strokes, the more efficiently the iV adaptation is executed.

The present invention is particularly favourable precisely for this requirement since as a result of the displacement according to the invention of the planar iV disks, exceedingly large cross-sections are formed with minimal pressure losses due to individual positionings at triple conveyed medium outlet flows, namely:

$G_{o1}$=outlet between the iV disks $G_{o2}$=outlet via the spindle rotor heads $G_{oS}$=outlet via the gas feed thread of the spindle rotor pair.

In addition, the easy manufacture with the best possible form fit accuracy at the same time is particularly advantageous since the working chamber internal contour surrounding the spindle rotor pair (2) at the compressor housing (1) can be manufactured with the iV disks (3) completely abutting, wherein the iV disks (3) are positioned exactly and reproducibly via position pins (4).

In addition, the actually effective iV value can be set flexibly and in arbitrary intermediate positions in each case by specific positionings $s_i$ with $0 \leq s_i \leq s_j$ in order to achieve the most efficient actually effective iV value in each case for the relevant operating point. In this case, in FIGS. 3 to 6 the respective path length $s_j$ is shown in a simplified manner only as s, a differentiation per iV disk ($\mathbf{3}_j$) can naturally be implemented and is dependent on the respective requirements.

Advantageously in the closed state of each of the iV disks, precisely the situation as during the manufacturing of the internal contour is achieved again and during removal, i.e. opening of the iV disks ($\mathbf{3}_j$), the clearance values are always non-critical due to the increase in the clearance values between the iV disks ($\mathbf{3}_j$) and the spindle rotor heads.

BRIEF DESCRIPTION OF THE DRAWINGS

The invention will be explained in detail hereinafter with reference to the appended figures. In the figures.

DETAILED DESCRIPTION OF THE INVENTION

The gas conveyor external thread per spindle rotor (2) is shown as a shaded area under the designation "ANGLE" according to the AutoCAD drawing software (i.e. at 45° two lines in each case, at right angles to one another, always arranged in alignment).

Figure 1:
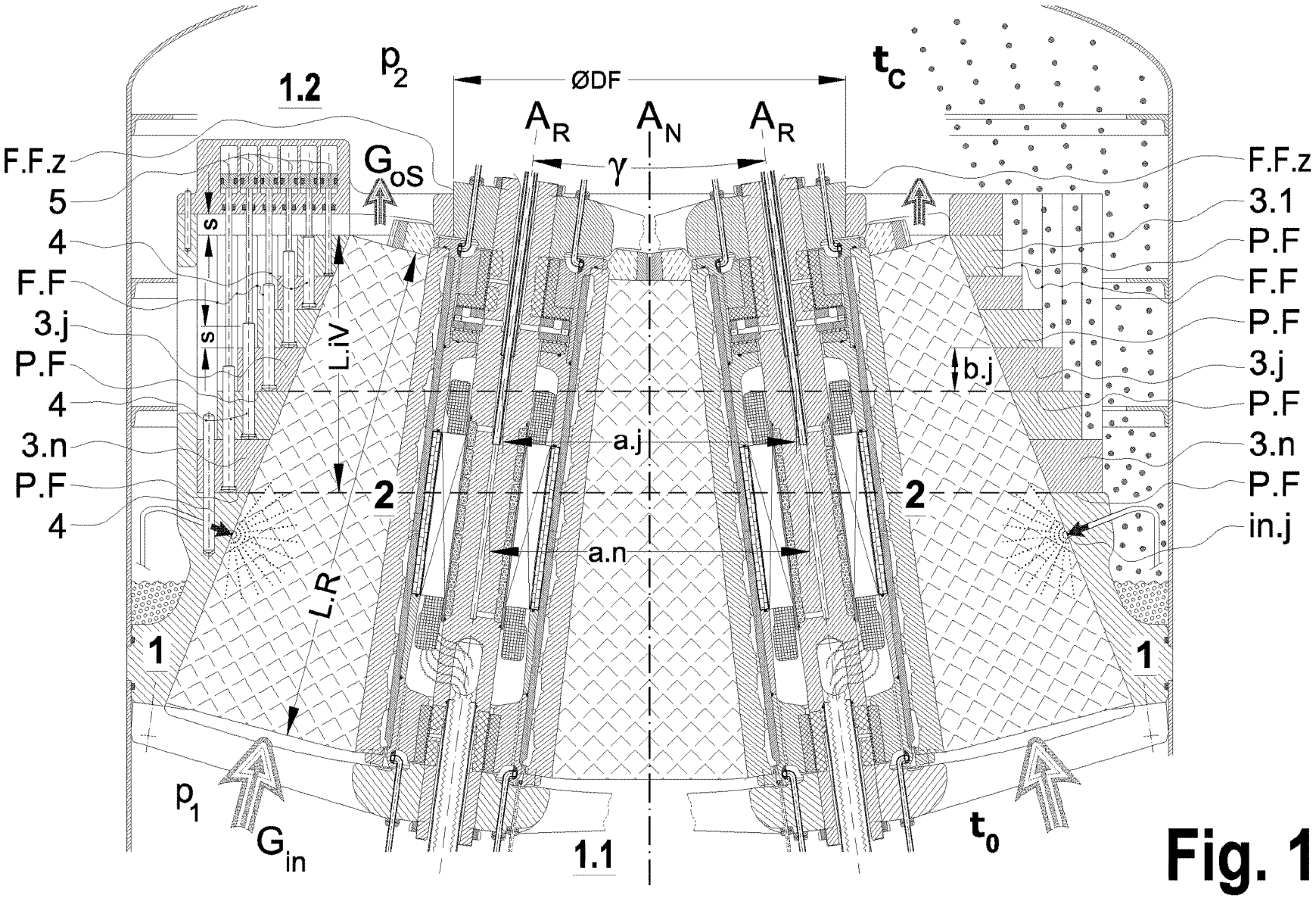
FIG. 1 shows a sectional view through an R718* compressor with iV disks completely in place.

FIG. 1 shows as an example a sectional view through the R718* compressor when all the iV disks ($\mathbf{3}_j$) for $1 \leq j \leq n$ where n is the number of these iV disks ($\mathbf{3}_j$) with a width b per iV disk ($\mathbf{3}_j$) are completely in place so that the maximum iV value for the corresponding compressor design is effective. Thus, as the gas fluid flow (G) there is only the outlet $G_{oS}$ via the gas conveyor thread of the spindle rotor pair (2). The number n of iV disks ($\mathbf{3}_j$) is determined according to the respective requirement profile in use of the R718* compressor wherein it holds that: the more iV disks ($\mathbf{3}_j$) are implemented, the more finely the actually effective iV value can be gradated, wherein the width $b_j$ of the respective iV disks should be taken into account.

In addition, as an example, planar surfaces $P_F$ are additionally plotted as dashed lines preferably perpendicular to the neutral axis $A_N$. In order to avoid canting during movement of the iV disks (3) as reliably as possible, additionally as an example, guide support surfaces $F_{Fz}$ are shown centrally to the neutral axis $A_N$ relative to ØDF.

Figure 2:
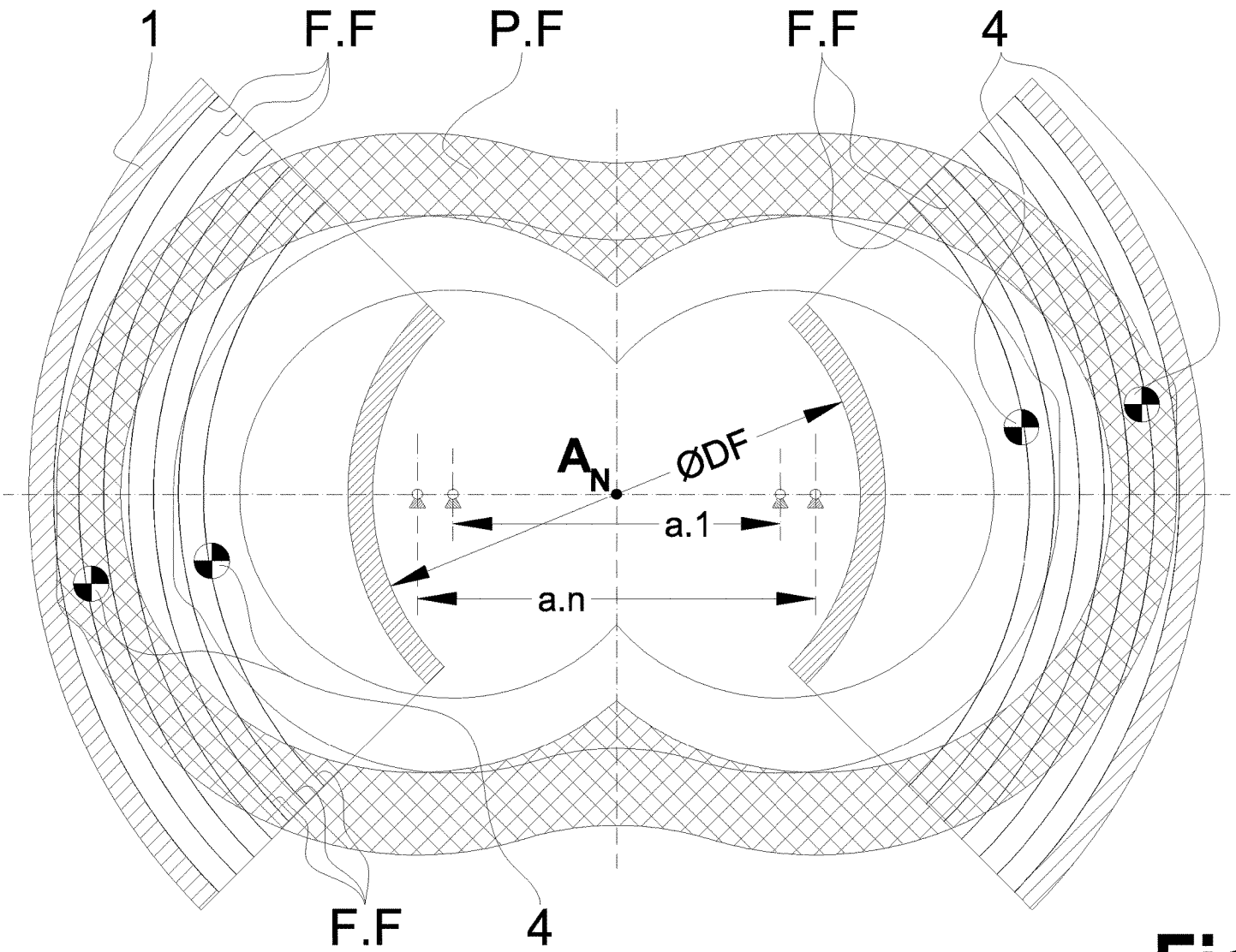
FIG. 2 shows a sectional view through an R718* compressor perpendicular to a neutral axis.

FIG. 2 shows as an example, a sectional view perpendicular to the neutral axis $A_N$ at a planar surface $P_F$ with cross-hatching. In addition, the preferably central guide support surfaces $F_F$ per iV disk are shown giving ØDF and the position pins (4) in pairs per iV disk for the exact positioning of each iV disk with respect to the spindle rotor pair (2).

Various positions of the iV disks ($\mathbf{3}_j$) for easy realization of different iV values according to the invention are shown in the following diagrams of FIG. 3 to FIG. 6, wherein for clarity only one side is shown, preferably executed as a mirror image to the neutral axis $A_N$.

Figure 3:
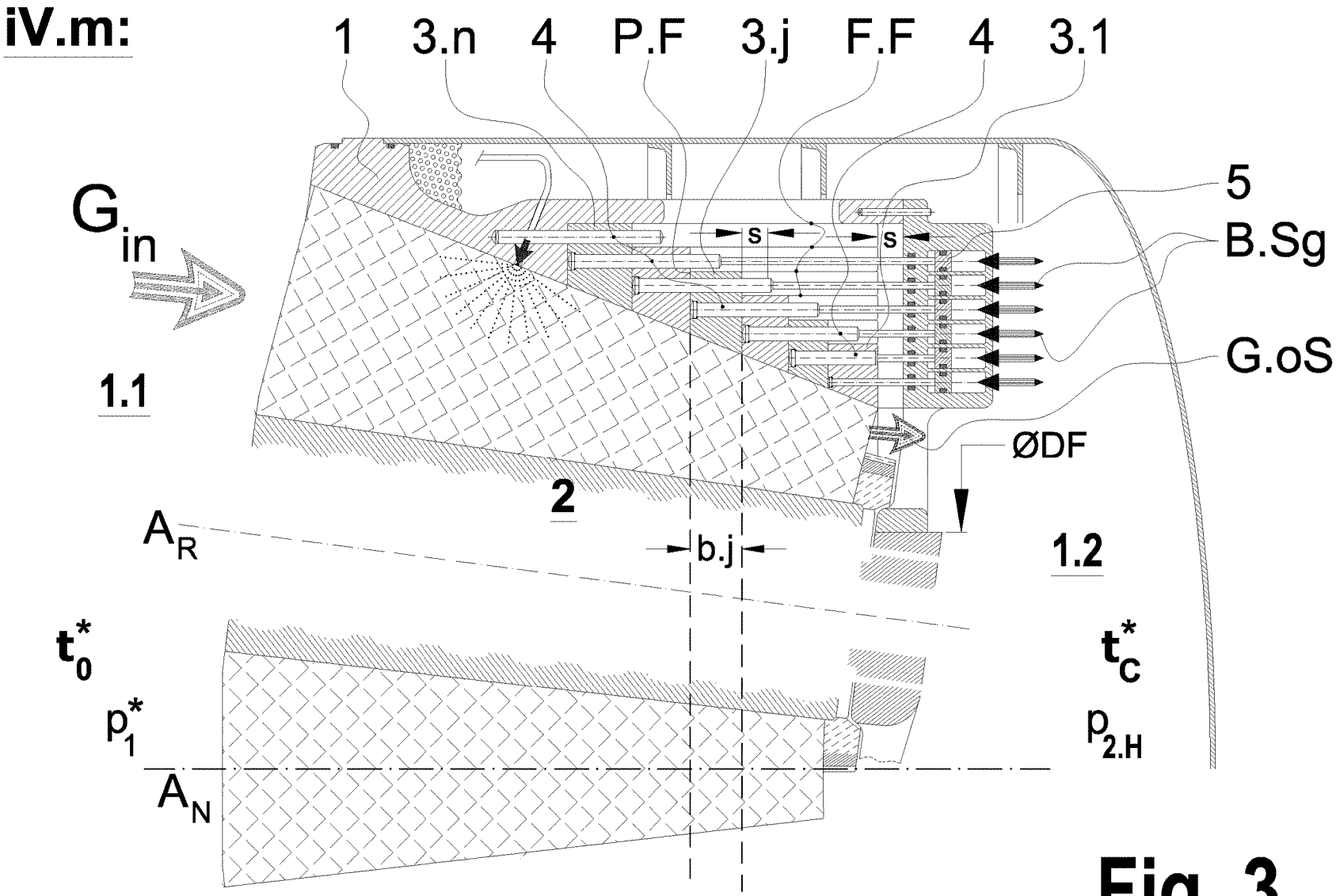
FIG. 3 shows a detailed enlargement of an R718* compressor.

The exemplary sectional view of FIG. 3 as a detailed enlargement of FIG. 1 under the title "iV.m" shows the so-called "closed" position when all the iV disks (3) are completely in place by the movement control devices (5) being set to $B_{Sg}$ and therefore the maximum iV value is effective. Thus, only the gas flow $G_{oS}$ leaves the R718* compressor via the gas conveyor thread. The pressure ratio is then $p_{2.H}$ at the compressor outlet (1.2) divided by $p_1$* at the inlet (1.1).

Figure 4:
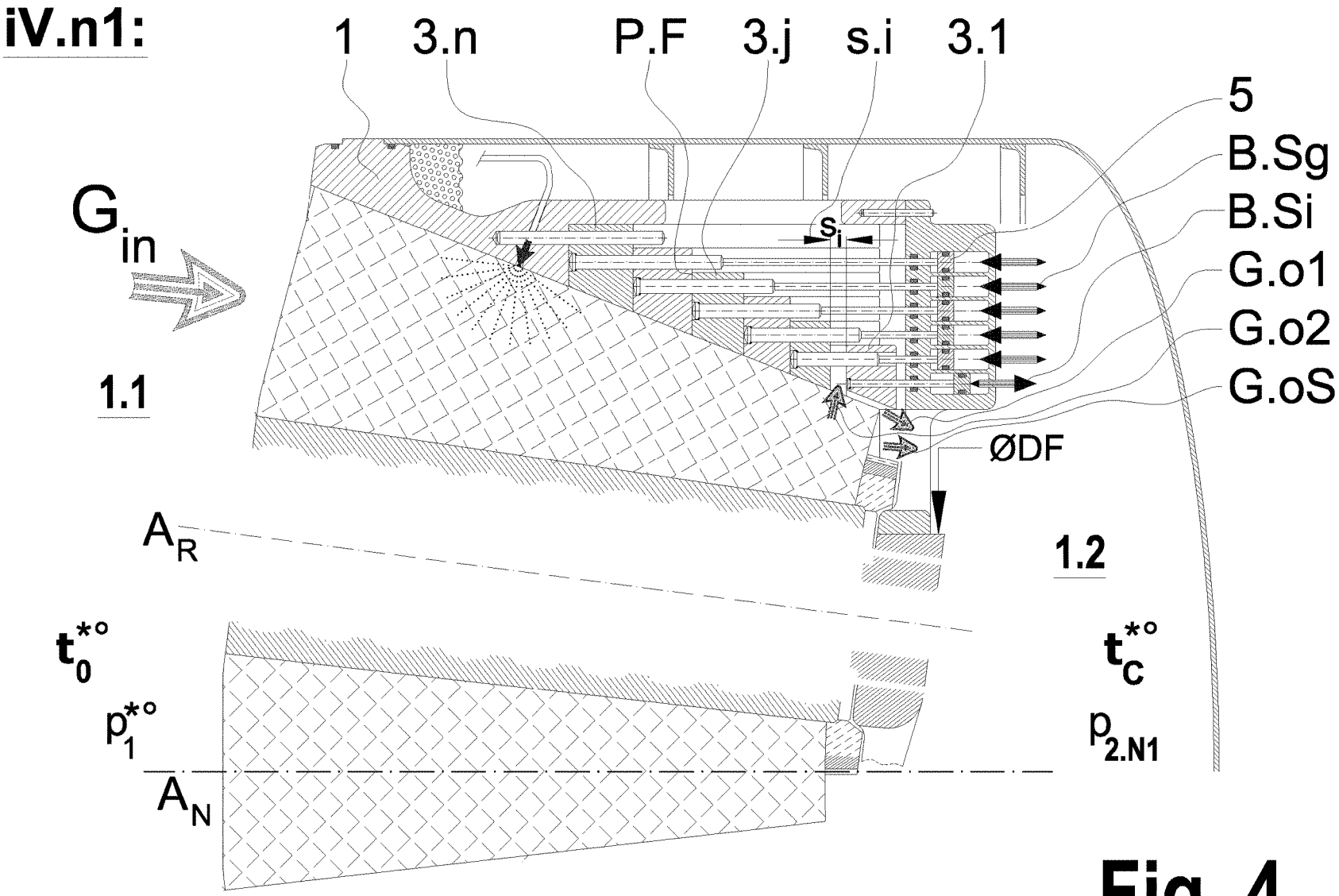
FIG. 4 shows a sectional view through an R718* compressor with a first displaced iV disk.

The exemplary sectional view of FIG. 4 as a continuation of FIG. 3 under the title "iV.n1" shows a position during displacement of the first iV disk (3.1) in that at the control device (5) for this iV disk (3.1) the motion control $B_{Si}$ for a desired intermediate position of this iV disk specifically sets the displacement distance $s_i$ with $0<s_i<s$ and thus for the first time the maximum iV value from FIG. 3 is undershot, i.e. when the first iV disk (3.1) leaves the "closed" position. When viewed from the compressor outlet (1.2) the first iV disk is counted as the first iV disk (3.1). In this position the gas flows $G_{o1}$ and $G_{o2}$ as well as $G_{oS}$ leave the R718* compressor. Unlike in FIG. 3 the pressure ratio is then $p_{2.N1}$ at the compressor outlet (1.2) divided by $p_1^{*o}$ at the inlet (1.1) at the corresponding vaporizer or liquefier temperatures.

Figure 5:
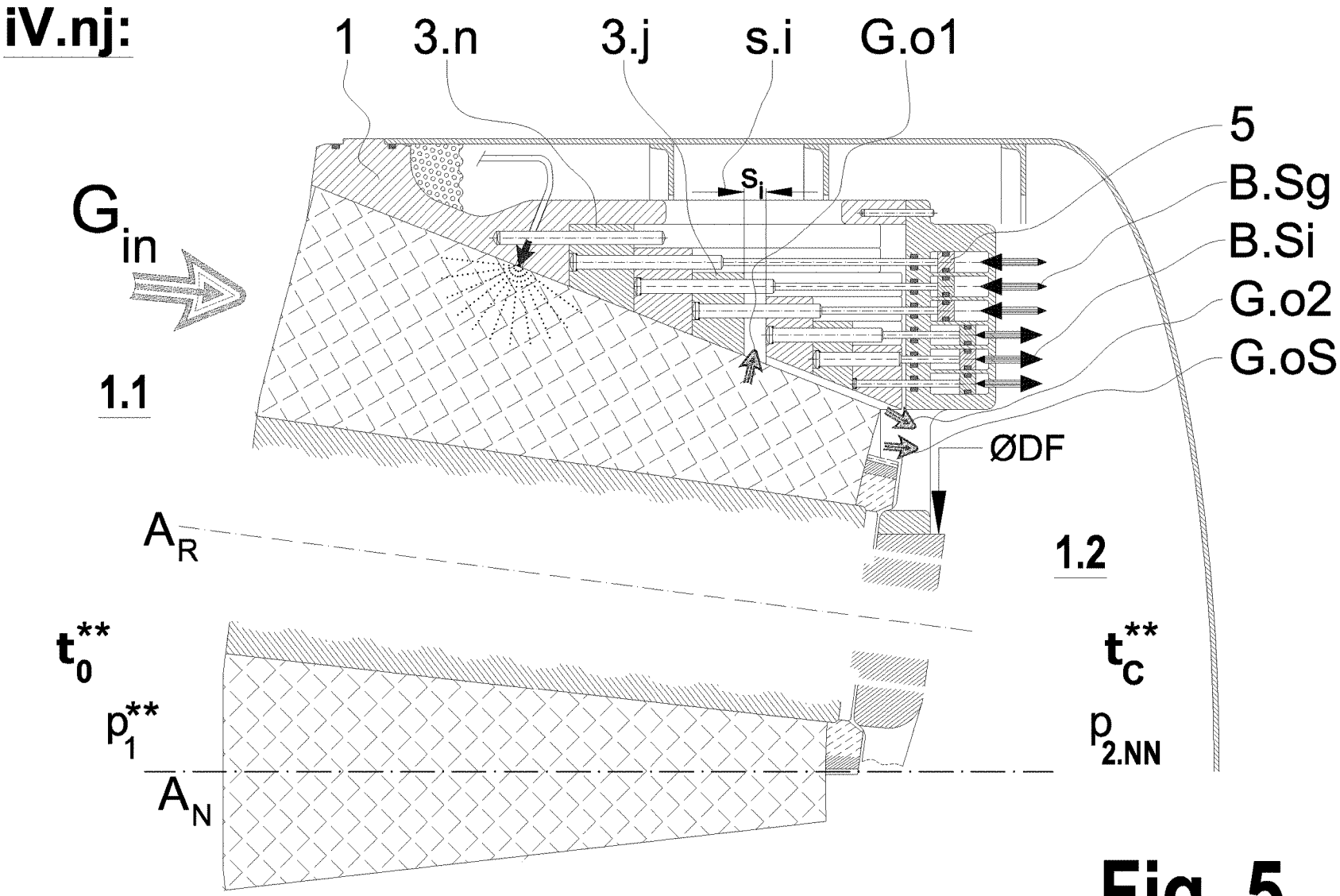
FIG. 5 shows a sectional view through an R718* compressor with several displaced iV disks.

The exemplary sectional diagram of FIG. 5 as a continuation of FIGS. 3 and 4 under the title "iV.nj" shows an arbitrary position during the displacement of several iV disks ($\mathbf{3}_j$*) with $1 \leq j^* \leq n$ for n as the number of iV disks, whereby at the control devices (5) for these iV disks ($\mathbf{3}_j$) the movement control $B_{Si}$ specifically sets the displacement distance $s_i$ where $0<s_i<s$ for a desired intermediate position of these iV disks (the plural is important) and thus each application-specific desired intermediate value for the currently effective iV value is achieved.

In this position the gas flows $G_{o1}$ and $G_{o2}$ as well as $G_{oS}$ leave the R718* compressor. Other than in FIG. 3 and FIG. 4, the pressure ratio is then $p_{2.NN}$ at the compressor outlet (1.2) divided by $p_1$ at the inlet (1.1**) at the corresponding vaporizer or liquefier temperatures.

Figure 6:
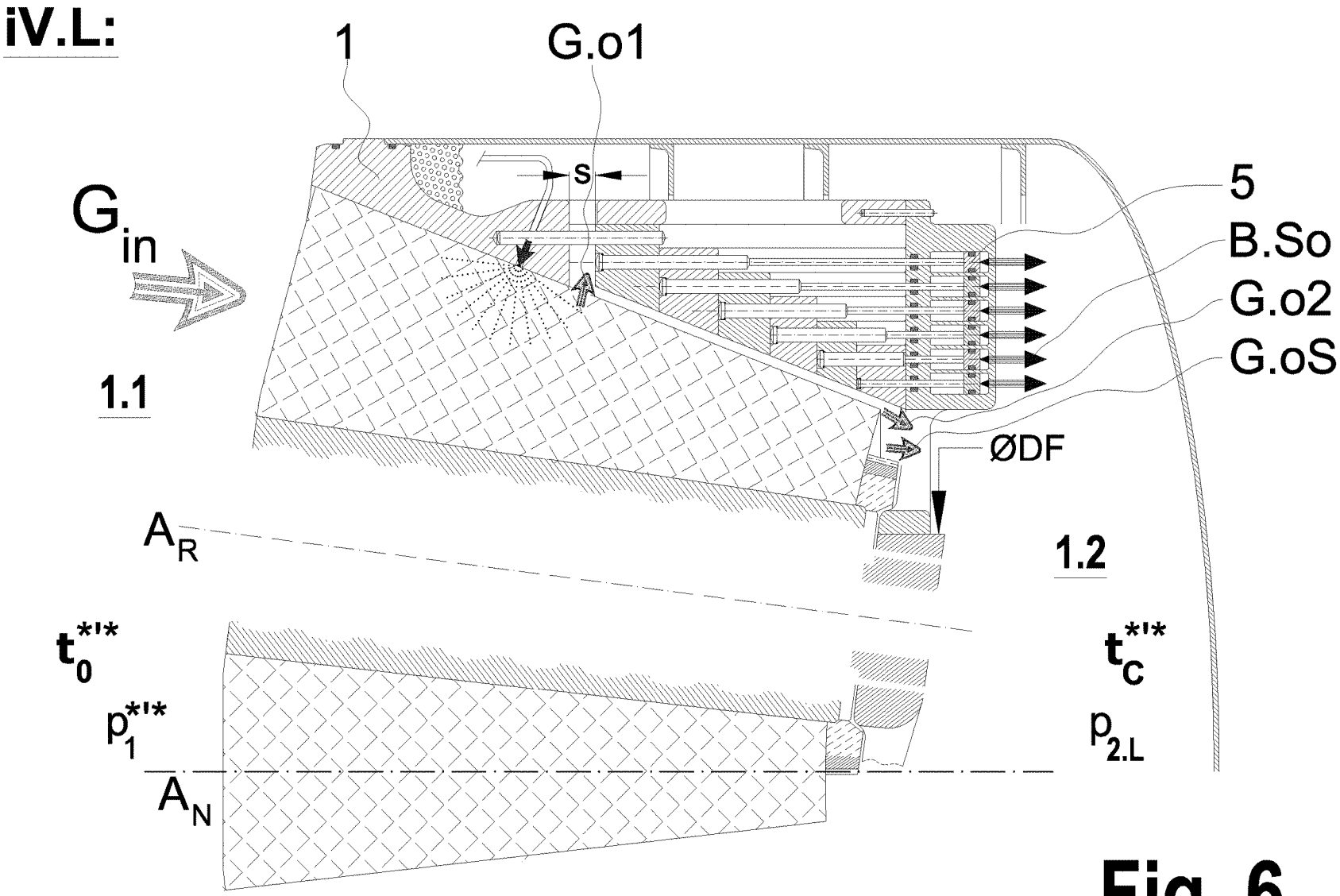
FIG. 6 shows a sectional view through an R718* compressor in which all the iV disks are displaced.

The exemplary sectional view of FIG. 6 as a continuation of FIGS. 3 and 4 and 5 under the title "iV.L" shows the position of the minimum effective iV value whereby all the iV disks are displaced by their complete displacement path per movement control $B_{So}$ for the open position.

In this position the gas flows $G_{o1}$ and $G_{o2}$ as well as $G_{oS}$ leave the R718* compressor. Other than previously the pressure ratio is then $p_{2.L}$ at the compressor outlet (1.2) divided by $p_1^{*'*}$ at the inlet (1.1) at the corresponding vaporizer or liquefier temperatures.

REFERENCE LIST

1. Compressor housing having an inlet side (1.1) with pressure $p_1$ and an outlet side (1.2) with $p_2$ with a neutral axis $A_N$ as angle bisector to the axis AR as axis of rotation

- 1.1 Compressor inlet side during operation with the pressure $p_1$ at a vaporization temperature $t_0$ and at the same time forming the vaporization space
- 1.2 compressor outlet side during operation at the pressure $p_2$ at a condensation temperature $t_C$ and at the same time forming the condensation space 2. Spindle rotor pair preferably with two-teeth mirror-symmetrically identical and multistage gas conveyor external thread and per spindle rotor with an axis of rotation $A_R$ at the angle γ with respect to one another and the neutral axis.
3. iV disks at a desired area of use having the width $b_j$ per iV disk ($3_j$) with index j where $1 \leq j \leq n$ and n is the number of iV disks with $n \geq 1$.
4. Position pins, preferably also with guide length and entrainment function.
5. Movement control devices per iV disk ($3_j$), preferably operated with water hydraulics.

LIST OF SYMBOLS

ØDF Central guide diameter with respect to the neutral axis $A_N$ for iV disks (3)
- $A_N$ Neutral axis as angle bisector of both axes of rotation $A_R$ with the angle γ with respect to one another in mirror-symmetrically identical spindle rotors
- $A_R$ Axis of rotation per spindle rotor or also so-called central line
- $F_F$ Guide support surfaces for preventing canting of the iV disks ($3_j$), preferably designed as circular segments (in order to save material)
  - $F_F$ Guide support surfaces centrally to the neutral axis $A_N$ with ØDF
- $P_F$ Planar surfaces between the iV disks in the case of planar abutment thanks to shiny smooth contact surface (preferably ground) acting in a sealing manner to the adjacent iV disk, shown as a dashed line for example in FIG. 1
- G Gas fluid flow
  - $G_{in}$ with index "in" at the compressor inlet
  - $G_o$ with index "o" at the compressor outlet, divided by means of displaced iV disks into
    - $G_{o1}$ outlet between the iV disks
    - $G_{o2}$ outlet via the spindle rotor heads
    - $G_{oS}$ outlet via the gas conveyor thread of the spindle rotor pair
- $B_S$ Movement diagram as positioning arrows for the respective iV disk ($3_j$) at the relevant movement control devices (5) shown as
  - $B_{Sg}$ movement control for closed position of the respective iV disk
  - $B_{Si}$ movement control for any intermediate position of the respective iV disk
  - $B_{So}$ movement control for the open position of the respective iV disk
- $b_j$ Width of the respective iV disk ($3_j$)
- $s_i$ Displacement distance for the respective iV disk with $0<s_i \leq s$
- $L_R$ Spindle rotor profile length
- $L_{iV}$ Length of all iV disks

The invention claimed is:

1. A R718* compressor as a two-shaft rotational displacement machine for conveying and compressing gaseous conveyed media, comprising:

a spindle rotor pair in a compressor housing at a pressure $p_1$ at a compressor inlet and during operation with a higher pressure $p_2$ at a compressor outlet, wherein axes of rotation $A_R$ of spindle rotors of the spindle rotor pair are aligned at an angle $\gamma>0$ with respect to one another, wherein a neutral axis $A_N$ is an angle bisector of the axes of rotation $A_R$;

wherein for adjustment of an internal volume ratio (as "iV value") of the R718* compressor, the compressor housing thereof starting from the outlet side with a rotor profile length $L_R$ over a length $L_{iV}$ comprises planar, flat iV disks ($3_j$) with the index j for $1 \leq j \leq n$ where n is the number of these iV disks ($3_j$) where $n \geq 1$ with a width $b_j$ per iV disk ($3_j$) having planar surfaces $P_F$, wherein the iV disks ($3_j$) for the respective operating conditions are specifically individually displaced parallel to the neutral axis $A_N$ via movement control devices ($5_j$) per iV disk ($3_j$) in each case by a distance $s_i$ where $0<s_i \leq s_j$ with $s_j$ as the maximum displacement distance per iV disk ($3_j$) and thus gas emissions $G_{o1}$ between the iV disks ($3_j$), $G_{o2}$ via spindle rotor heads as well as $G_{oS}$ via a gas feed thread of the spindle rotor pair into an outlet chamber are made possible to largely avoid over or under-compression which is harmful to the efficiency in the R718* compressor.

2. The R718* compressor according to claim 1, wherein a precise positioning of each iV disk ($3_j$) is accomplished via position pins with respect to the compressor housing and with respect to one another so that in the closed state when all the iV disks ($3_j$) abut in a clearly defined manner against one another via the position pins, clearance values between the spindle rotor pair and the compressor housing are always maintained, wherein a production machining of an internal contour of the compressor housing is accomplished in this state of the completely abutting iV disks.

3. The R718* compressor according to claim 2, wherein the position pins take over both the exact positioning per iV disk ($3_j$) and also during displacement of the iV disks via the movement control devices ($5_j$) the guidance and entrainment thereof.

4. The R718* compressor according to claim 1, wherein the movement control devices ($5_j$) per iV disk ($3_j$) are operated with R718* water hydraulics and for each operating point any intermediate position $s_i$ where $0<s_i \leq s_j$ with $s_j$ as the maximum displacement distance per iV disk ($3_j$) is made possible.

5. The R718* compressor according to claim 1, wherein the planar surfaces ($P_F$) per iV disk ($3_j$) are designed for easy sealing with respect to one another and with respect to the compressor housing.

6. The R718* compressor according to claim 1, wherein guide support surfaces ($F_F$) are designed in such a manner that during displacement of the respective iV disks ($3_j$) with correspondingly suitable application of force via the movement control devices ($5_j$) for displacement of the respective iV disks ($3_j$) a circumferentially uniform movement of the respective iV disks ($3_j$) over corresponding guide lengths and guide accuracies is ensured and any canting of the iV disks ($3_j$) is avoided.

7. The R718* compressor according to claim 6, wherein the guide support surfaces ($F_F$) are related to a central guide diameter ØDF as well as a uniform application of force via the movement control devices ($5_j$) per iV disk ($3_j$).

8. The R718* compressor according to claim 1, wherein the iV disks ($3_j$) are positioned for respective working/operating point in such a manner via the movement control devices ($5_j$) per iV disk ($3_j$) that the R718* compressor is operated with the lowest energy expenditure.

9. The R718* compressor according to claim 1, wherein with the rotor profile length $L_R$ the length $L_{iV}$ of the iV disks ($3_j$) is designed in such a manner that at least first working chambers on the compressor inlet (1.1) always remain closed.

10. The R718* compressor according to claim 1, wherein the planar surfaces $P_F$ are perpendicular to the neutral axis $A_N$.

11. The R718* compressor according to claim 1, wherein the planar surfaces $P_F$ circumferentially surround the spindle rotor pair, and wherein the planar surfaces $P_F$ in the case of planar abutment act in a sealing manner to an adjacent one of the iV disks.

* * * * *